US008970383B2

(12) United States Patent
Liou et al.

(10) Patent No.: US 8,970,383 B2
(45) Date of Patent: Mar. 3, 2015

(54) ELECTRONIC WARNING DEVICE WITH SCENT DISPERSION MECHANISM

(71) Applicant: Arcadyan Technology Corporation, Hsinchu (TW)

(72) Inventors: Guan-De Liou, Hsinchu (TW); Jen-Hsiang Fang, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 13 days.

(21) Appl. No.: 13/904,289

(22) Filed: May 29, 2013

(65) Prior Publication Data

US 2014/0285345 A1 Sep. 25, 2014

(30) Foreign Application Priority Data

Mar. 22, 2013 (TW) ..... 102110259 A

(51) Int. Cl.
*G08B 17/00* (2006.01)
*G08B 21/18* (2006.01)

(52) U.S. Cl.
CPC ..... *G08B 21/18* (2013.01)
USPC ..... 340/584; 340/636.11; 340/3.7

(58) Field of Classification Search
USPC ..... 340/584, 586, 588–589, 581, 616, 618, 340/622, 655, 639, 661, 3.7
See application file for complete search history.

(56) References Cited

U.S. PATENT DOCUMENTS

| | | | | |
|---|---|---|---|---|
| 8,663,553 | B2 * | 3/2014 | Elrod | 422/5 |
| 2008/0160151 | A1 * | 7/2008 | Zeller et al. | 426/569 |
| 2009/0050835 | A1 * | 2/2009 | Boise et al. | 251/320 |
| 2010/0243754 | A1 * | 9/2010 | Harris | 239/34 |
| 2011/0278371 | A1 * | 11/2011 | Rydbom | 239/34 |

* cited by examiner

*Primary Examiner* — Daniel Previl
(74) *Attorney, Agent, or Firm* — WPAT, PC; Justin King

(57) ABSTRACT

An electronic warning device with scent dispersion mechanism is disclosed, which comprises: an electronic element; and at least two scent sources, featured with different vaporization temperatures while being disposed simultaneously on the electronic element. In an embodiment, there are two scent sources, i.e. a first scent source that can be vaporized at a first vaporization temperature, and a second scent source that can be vaporized at a second vaporization temperature, whereas the second vaporization temperature is higher than the first vaporization temperature. Thereby, operationally, when the temperature of the electronic element that is operating normally and reaches the first vaporization temperature, the first scent source is vaporized, but when the electronic element is operating abnormally for causing the temperature of the electronic element to be raised to a temperature higher than the second vaporization temperature, the second scent source is vaporized to be detected by users as a warning signal.

8 Claims, 2 Drawing Sheets

ELECTRONIC WARNING DEVICE WITH SCENT DISPERSION MECHANISM

FIELD OF THE INVENTION

The present invention relates to an electronic warning device with scent dispersion mechanism, and more particularly, to an electronic element having at least two scent sources disposed there at that is able to emit a scent as a warning signal when the electronic element is operating abnormally.

BACKGROUND OF THE INVENTION

With rapid advance of technology, networks as well as networking devices are becoming common and essential in our daily life, not to mention that they are generally required to be operating 24 hours, seven days, all year round. Consequently, electronic components that are built inside those network devices should be design to function in a high-temperature environment. However, if there is no device to monitor and control the working temperatures of those electronic components for networking, they can crash and burn easily due to overheat. Therefore, for every network, it is important to have some sort of temperature monitor built therein.

There are two types of temperature monitors that are currently available on the market, which are the visual indicators, such as LED indicators, and the alarm devices, such as a buzzer, and both of which are capable of issuing a warning signal to a user for reminding the user that the working temperature of the electronic component it is monitoring had reached a predefined threshold. However, the warning signals from those two conventional temperature monitors may not be very effective and can sometimes be ignored by careless users. Therefore, it is in need of an improved warning device capable issuing a warning signal different from those visual signals and audio signals.

SUMMARY OF THE INVENTION

In view of the disadvantages of prior art, the primary object of the present invention is to provide an electronic warning device with scent dispersion mechanism, which comprises: an electronic element; and at least two scent sources, featured with different vaporization temperatures while being disposed simultaneously on the electronic element. In this embodiment, there are two scent sources, i.e. a first scent source that can be vaporized at a first vaporization temperature, and a second scent source that can be vaporized at a second vaporization temperature, whereas the second vaporization temperature is higher than the first vaporization temperature. Thereby, operationally, when the temperature of the electronic element that is operating normally and reaches the first vaporization temperature, the first scent source is vaporized, but when the electronic element is operating abnormally for causing the temperature of the electronic element to be raised to a temperature higher than the second vaporization temperature, the second scent source is vaporized to be detected by users as a warning signal.

Another object of the invention is to provide an electronic element having three scent sources disposed there at, i.e. a first scent source, a second scent source and a third scent source, while allowing the first scent source to be vaporized at a first vaporization temperature, the second scent source to be vaporized at a second vaporization temperature, and the third scent source to be vaporized at a third vaporization temperature; wherein the third vaporization temperature is higher than the second vaporization temperature while the second vaporization temperature is higher than the first vaporization temperature; and operationally, when the temperature of the electronic element that is operating normally and reaches the first vaporization temperature, the first scent source is vaporized, and when the electronic element is operating abnormally for causing the temperature of the electronic element to be raised to a temperature higher than the second vaporization temperature but still lower than the third vaporization temperature, the second scent source is vaporized to be detected by users as a mild warning signal, but when the electronic element is operating abnormally for causing the temperature of the electronic element to be raised to a temperature higher than the third vaporization temperature, the third scent source is vaporized to be detected by users as a severe warning signal.

To achieve the above objects, the present invention provides an electronic warning device with scent dispersion mechanism, which comprises:

- a housing, having a plurality of heat dissipation holes formed there at;
- a printed circuit board;
- a heat-generating electronic element, disposed on the printed circuit board;
- a first scent source, attached to the heat-generating electronic element, capable of being vaporized at a first vaporization temperature; and
- a second scent source, attached to the heat-generating electronic element, capable of being vaporized at a second vaporization temperature that is higher than the first vaporization temperature;
- wherein, both the vaporized first and second scent sources are allowed to dissipate and discharge through the plural heat dissipation holes.

Preferably, the electronic warning device with scent dispersion mechanism is a device selected from the group consisting of: a network device, and a fixed communication equipment.

Preferably, the heat-generating electronic element is a component selected from the group consisting of: a micro control unit, a central process unit, a chip module and a power module.

Preferably, both the first and second scent sources are disposed and received inside a device selected from the group consisting of: a solid odor absorber, a liquid odor absorber and a perfume container.

To achieve the above objects, the present invention provides an electronic warning device with scent dispersion mechanism, which comprises:

- a housing, having a plurality of heat dissipation holes formed there at;
- a printed circuit board;
- a heat-generating electronic element, disposed on the printed circuit board;
- a first scent source, attached to the heat-generating electronic element, capable of being vaporized at a first vaporization temperature;
- a second scent source, attached to the heat-generating electronic element, capable of being vaporized at a second vaporization temperature that is higher than the first vaporization temperature; and
- a third scent source, attached to the heat-generating electronic element, capable of being vaporized at a third vaporization temperature that is higher than the second vaporization temperature;

wherein, all the vaporized first, second and third scent sources are allowed to dissipate and discharge through the plural heat dissipation holes.

Preferably, the electronic warning device with scent dispersion mechanism is a device selected from the group consisting of: a network device, and a fixed communication equipment.

Preferably, the heat-generating electronic element is a component selected from the group consisting of: a micro control unit, a central process unit, a chip module and a power module.

Preferably, all the first, second and third scent sources are disposed and received inside a device selected from the group consisting of: a solid odor absorber, a liquid odor absorber and a perfume container.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
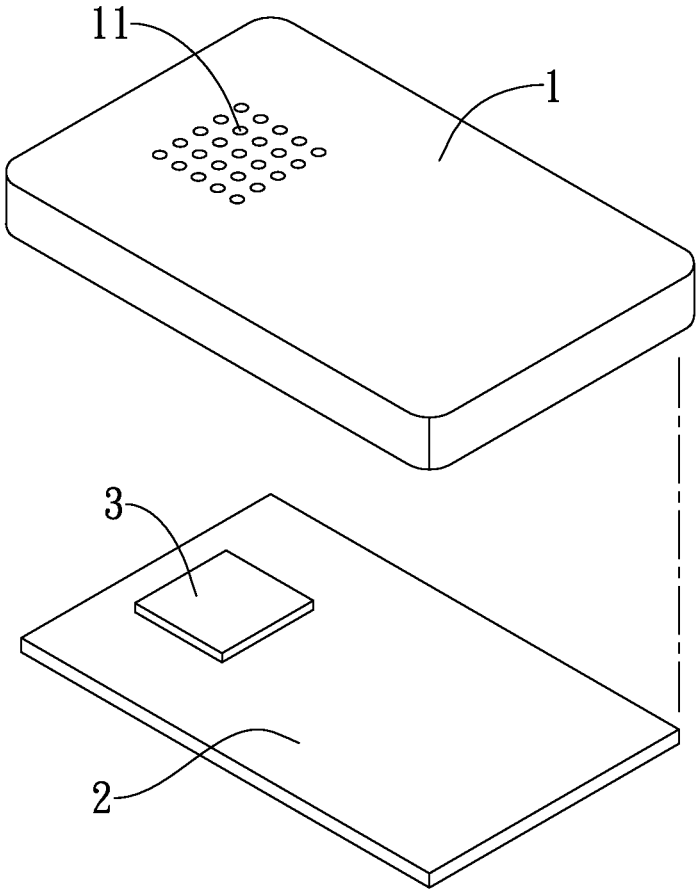
FIG. 1 is a three-dimensional diagram showing a housing, a print circuit board and a heat-generating electronic element of an electronic warning device with scent dispersion mechanism according to an embodiment of the present invention.

Please refer to FIG. 1, which is a three-dimensional diagram showing a housing, a print circuit board and a heat-generating electronic element of an electronic warning device with scent dispersion mechanism according to an embodiment of the present invention. As shown in FIG. 1, the electronic warning device has a housing 1 which has a plurality of heat dissipation holes formed there at. In this embodiment, the housing 1 is a one-half case, but is not limited thereby. In addition, the electronic warning device comprises: a printed circuit board 2, disposed inside the housing 1; a heat-generating electronic element 3, disposed on the printed circuit board 2. It is noted that the heat-generating electronic element 3 is a component selected from the group consisting of: a micro control unit, a central process unit, a chip module and a power module; whereas the electronic warning device with scent dispersion mechanism is a device selected from the group consisting of: a network device, and a fixed communication equipment.

Figure 2A:
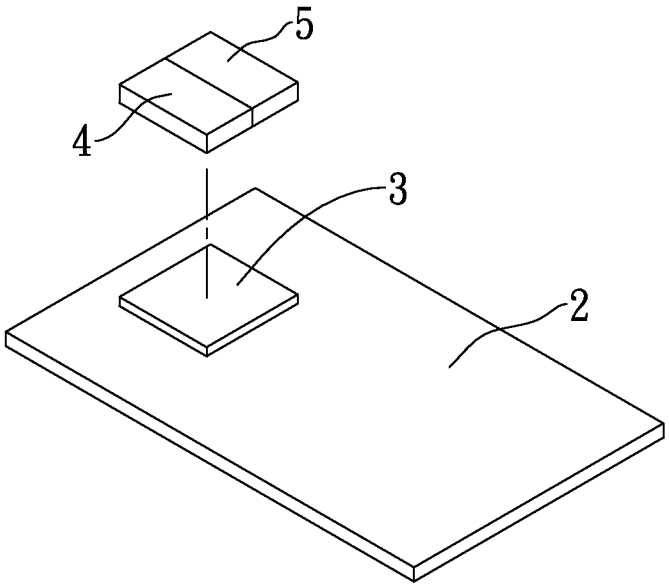
FIG. 2A is a three-dimensional diagram showing a heat-generating electronic element having two scent sources disposed there at according to an embodiment of the present invention.

Please refer to FIG. 2A, which is a three-dimensional diagram showing a heat-generating electronic element having two scent sources disposed there at according to an embodiment of the present invention. In this embodiment, the electronic warning device comprises: a printed circuit board 2; a heat-generating electronic element 3, disposed on the printed circuit board 2; a first scent source 4, attached to the heat-generating electronic element 3, capable of being vaporized at a first vaporization temperature; and a second scent source 5, attached to the heat-generating electronic element 3, capable of being vaporized at a second vaporization temperature that is higher than the first vaporization temperature; wherein, both the vaporized first and second scent sources 4, 5 are allowed to dissipate and discharge through the plural heat dissipation holes of FIG. 1. Moreover, both the first and second scent sources 4, 5 are disposed and received inside a device selected from the group consisting of: a solid odor absorber, a liquid odor absorber and a perfume container.

Figure 2B:
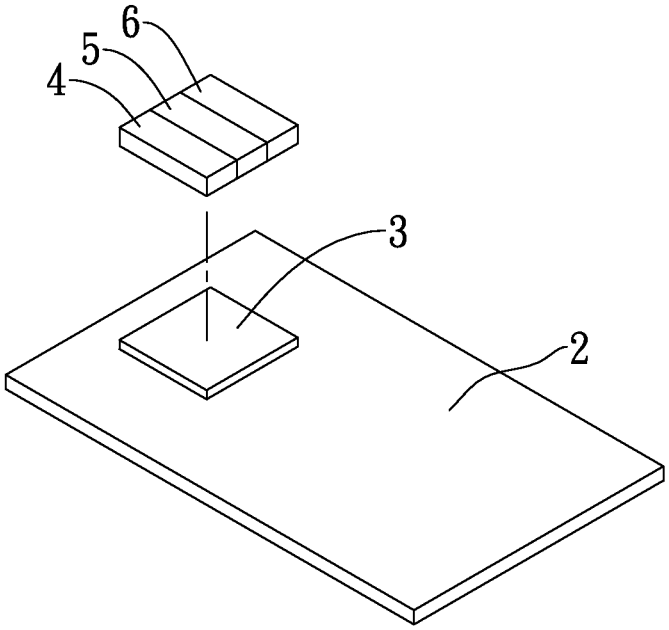
FIG. 2B is a three-dimensional diagram showing a heat-generating electronic element having three scent sources disposed there at according to an embodiment of the present invention.

Please refer to FIG. 2B, which is a three-dimensional diagram showing a heat-generating electronic element having three scent sources disposed there at according to an embodiment of the present invention. In this embodiment, the electronic warning device comprises: a printed circuit board 2; a heat-generating electronic element 3, disposed on the printed circuit board 2; a first scent source 4, attached to the heat-generating electronic element 3, capable of being vaporized at a first vaporization temperature; a second scent source 5, attached to the heat-generating electronic element 3, capable of being vaporized at a second vaporization temperature that is higher than the first vaporization temperature; and a third scent source 6, attached to the heat-generating electronic element 3, capable of being vaporized at a third vaporization temperature that is higher than the second vaporization temperature; wherein, all the vaporized first, second and third scent sources 4, 5, 6 are allowed to dissipate and discharge through the plural heat dissipation holes of FIG. 1. Moreover, all the first, second and third scent sources 4, 5, 6 are disposed and received inside a device selected from the group consisting of: a solid odor absorber, a liquid odor absorber and a perfume container.

To sum up, the present invention provides an electronic warning device with scent dispersion mechanism, which comprises: an electronic element; and at least two scent sources, featured with different vaporization temperatures while being disposed simultaneously on the electronic element. In this embodiment, there are two scent sources, i.e. a first scent source that can be vaporized at a first vaporization temperature, and a second scent source that can be vaporized at a second vaporization temperature, whereas the second vaporization temperature is higher than the first vaporization temperature. Thereby, operationally, when the temperature of the electronic element that is operating normally and reaches the first vaporization temperature, the first scent source is vaporized, but when the electronic element is operating abnormally for causing the temperature of the electronic element to be raised to a temperature higher than the second vaporization temperature, the second scent source is vaporized to be detected by users as a warning signal. Moreover, the present invention further provides an electronic element having three scent sources disposed there at, i.e. a first scent source, a second scent source and a third scent source, while allowing the first scent source to be vaporized at a first vaporization temperature, the second scent source to be vaporized at a second vaporization temperature, and the third scent source to be vaporized at a third vaporization temperature; wherein the third vaporization temperature is higher than the second vaporization temperature while the second vaporization temperature is higher than the first vaporization temperature; and operationally, when the temperature of the electronic element that is operating normally and reaches the first vaporization temperature, the first scent source is vaporized, and when the electronic element is operating abnormally for causing the temperature of the electronic element to be raised to a temperature higher than the second vaporization temperature but still lower than the third vaporization temperature, the second scent source is vaporized to be detected by users as a mild warning signal, but when the electronic element is operating abnormally for causing the temperature of the electronic element to be raised to a temperature higher than the third vaporization temperature, the third scent source is vaporized to be detected by users as a severe warning signal.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An electronic warning device with scent dispersion mechanism, comprising:

a housing, having a plurality of heat dissipation holes;

a print circuit board;

a heat-generating electronic element, disposed on the printed circuit board;

a first scent source, attached to the heat-generating electronic element, capable of being vaporized at a first vaporization temperature; and a second scent source, attached to the heat-generating electronic element, capable of being vaporized at a second vaporization temperature, wherein the second vaporization temperature is higher than the first vaporization temperature;

wherein, both the vaporized first and second scent sources are allowed to dissipate and discharge through the plural heat dissipation holes.

2. The electronic warning device of claim 1, being a device selected from the group consisting of: a network device, and a fixed communication equipment.

3. The electronic warning device of claim 1, wherein the heat-generating electronic element is a component selected from the group consisting of: a micro control unit, a central process unit, a chip module and a power module.

4. The electronic warning device of claim 1, wherein both the first and second scent sources are disposed and received inside a device selected from the group consisting of: a solid odor absorber, a liquid odor absorber and a perfume container.

5. An electronic warning device with scent dispersion mechanism, comprising:

a housing, having a plurality of heat dissipation holes;

a printed circuit board;

a heat-generating electronic element, disposed on the printed circuit board;

a first scent source, attached to the heat-generating electronic element, capable of being vaporized at a first vaporization temperature;

a second scent source, attached to the heat-generating electronic element, capable of being vaporized at a second vaporization temperature, wherein the second vaporization temperature is higher than the first vaporization temperature; and a third scent source, attached to the heat-generating electronic element, capable of being vaporized at a third vaporization temperature that is higher than the second vaporization temperature;

wherein, all the vaporized first, second and third scent sources are allowed to dissipate and discharge through the plural heat dissipation holes.

6. The electronic warning device of claim 5, being a device selected from the group consisting of: a network device, and a fixed communication equipment.

7. The electronic warning device of claim 5, wherein the heat-generating electronic element is a component selected from the group consisting of: a micro control unit, a central process unit, a chip module and a power module.

8. The electronic warning device of claim 5, wherein all the first, second and third scent sources are disposed and received inside a device selected from the group consisting of: a solid odor absorber, a liquid odor absorber and a perfume container.

* * * * *